US008044977B2

(12) United States Patent
Lee et al.

(10) Patent No.: US 8,044,977 B2
(45) Date of Patent: Oct. 25, 2011

(54) DATA DRIVER CIRCUITS FOR A DISPLAY IN WHICH A DATA CURRENT IS GENERATED RESPONSIVE TO THE SELECTION OF A SUBSET OF A PLURALITY OF REFERENCE CURRENTS BASED ON A GAMMA SIGNAL AND METHODS OF OPERATING THE SAME

(75) Inventors: Jaehoon Lee, Gyeonggi-do (KR); Hansu Pae, Gyeonggi-do (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 1019 days.

(21) Appl. No.: 11/457,742

(22) Filed: Jul. 14, 2006

(65) Prior Publication Data

US 2007/0040773 A1 Feb. 22, 2007

(30) Foreign Application Priority Data

Aug. 18, 2005 (KR) ..... 10-2005-0075543

(51) Int. Cl.
*G09G 5/10* (2006.01)

(52) U.S. Cl. ..... 345/690

(58) Field of Classification Search ..... 345/82–100, 345/690

See application file for complete search history.

(56) References Cited

U.S. PATENT DOCUMENTS

| | | | | |
|---|---|---|---|---|
| 5,119,086 | A * | 6/1992 | Nishioka et al. | 345/690 |
| 6,331,844 | B1 * | 12/2001 | Okumura et al. | 345/87 |
| 6,344,857 | B1 | 2/2002 | Matono et al. | 345/600 |
| 7,023,458 | B2 * | 4/2006 | Kudo et al. | 345/690 |
| 2003/0080934 | A1 * | 5/2003 | Ishiyama | 345/100 |
| 2003/0214522 | A1 * | 11/2003 | Kageyama et al. | 345/690 |

FOREIGN PATENT DOCUMENTS

CN 1614662 A 5/2005

OTHER PUBLICATIONS

First Office Action corresponding to Chinese Patent Application No. 200610115559 dated Dec. 4, 2009; 6 pages.

* cited by examiner

*Primary Examiner* — Richard Hjerpe
*Assistant Examiner* — Carolyn R Edwards
(74) *Attorney, Agent, or Firm* — Myers Bigel Sibley & Sajovec

(57) ABSTRACT

A data driver for a display includes a reference current generator that is configured to generate L gray scale reference currents, the L gray scale reference currents being associated with non-zero gray scale levels, a gamma selection module that is configured to select M gamma reference currents from the L gray scale reference currents responsive to a gamma signal, a gamma voltage generator that is configured to generate a zero gray scale level gamma reference voltage, and a data current generator that is configured to generate a data current responsive to a selected one of the M gamma reference currents or the zero gray scale level gamma reference voltage responsive to a color signal.

30 Claims, 11 Drawing Sheets

DATA DRIVER CIRCUITS FOR A DISPLAY IN WHICH A DATA CURRENT IS GENERATED RESPONSIVE TO THE SELECTION OF A SUBSET OF A PLURALITY OF REFERENCE CURRENTS BASED ON A GAMMA SIGNAL AND METHODS OF OPERATING THE SAME

RELATED APPLICATION

This application claims the benefit of and priority to Korean Patent Application No. 10-2005-0075543, filed Aug. 18, 2005, in the Korean Intellectual Property Office, the disclosure of which is hereby incorporated herein by reference as if set forth in its entirety.

FIELD OF THE INVENTION

The present invention relates generally to integrated circuit devices and methods of operating the same and, more particularly, to data drivers for a display device and methods of operating the same.

BACKGROUND OF THE INVENTION

Organic light emitting diode (OLED) display devices are often characterized as having good linearity between a device current and device luminance. As a result, it is generally easy to adjust the luminance by controlling the device current. In driving an OLED display device, two approaches are typically used: an active matrix approach and a passive matrix approach. In the active matrix approach, the luminance is adjusted by controlling a voltage or a current of the device. In a passive matrix approach, the luminance is adjusted by controlling a duty ratio of the driving signal. The image data is proportional to the light intensity, but the image display device typically has a non-linear relationship between the input image data (gray scale input) and the output luminance. In many displays, the relationship between the gray scale input and the luminance that is output is an exponential relationship where the exponent is called gamma. If the gamma value is not set correctly, then there may be distortion in the displayed image resulting in degradations in the image quality. Different display devices typically have different optimal gamma values such that each device adjusts the gamma to optimize the image quality on the display. In OLED displays, the driving circuit controls the driving current of the driving transistor.

FIG. 1 is a block diagram of a conventional data driver circuit 20 for a display that provides gamma correction. The conventional data driver circuit 20 includes a controller 21, a lookup table 22, and a plurality of digital-to-analog converters (DACs) 23. The lookup table includes corrected gamma values for the red (R), green (G), and blue (B) color intensities for each pixel. The controller 21 receives video or color data 27 and a look-up table setting command 29 from an external controller 25, and receives 8-bit corrected gray scale data 26 from the lookup table 22. The 6-bit color data 27 are assigned to the respective R, G, and B colors to display 260K colors. The controller 21 receives the 6-bit color data and the 8-bit lookup table setting command and provides the 6-bit color data as an input 24 to the lookup table 22. In response, the lookup table 22 provides gamma corrected 8-bit gray scale data 26 to the controller 21. The 8-bit gray scale data 26 are generated by gamma correcting the 6-bit color data 24 and adding two additional dummy bits. The 8-bit gray scale data 26 are provided to the DACs 23, which generate the data current IDATA in response thereto.

Unfortunately, the lookup table 22 and the DACs 23 take up a relatively large amount of chip area and are relative complex due, at least in part, to the two additional dummy bits used in the 8-bit gray scale data 26. Moreover, the mapping data contained in the lookup table 22 may need to be refreshed periodically to account for noise in the system.

SUMMARY

According to some embodiments of the present invention, a data driver for a display is operated by generating L gray scale reference currents, the L gray scale reference currents being associated with non-zero gray scale levels, selecting M gamma reference currents from the L gray scale reference currents responsive to a gamma signal, generating a zero gray scale level gamma reference voltage, selecting one of the M gamma reference currents or the zero gray scale level gamma reference voltage responsive to a color signal, and generating a data current responsive to the selected one of the M gamma reference currents or zero gray scale level gamma reference voltage.

In other embodiments, selecting the M gamma reference currents comprises decoding the gamma signal to generate a gamma current selection signal and operating M gamma selection switches that select the M gamma reference currents, respectively, responsive to the gamma current selection signal.

In still other embodiments, generating the L gray scale reference currents comprises generating the L gray scale reference currents using a current mirror comprising L transistors having L different widths.

In still other embodiments, selecting one of time M gamma reference currents or the zero gray scale level gamma reference voltage comprises generating M additional gamma reference voltages based on the M gamma reference currents, respectively, and selecting one of the M+1 gamma reference voltages responsive to the color signal. Generating the data current comprises generating the data current responsive to the selected one of the M+1 gamma reference voltages.

In still other embodiments, selecting one of the M+1 gamma reference voltages comprises decoding the color signal to generate a gamma reference voltage selection signal and operating one of M+1 switches, respectively associated with the M+1 gamma reference voltages, responsive to the gamma reference voltage selection signal to couple the selected one of the M+1 gamma reference voltages to an output node.

In still other embodiments, generating the data current comprises driving a data current transistor coupled to the output node using the selected one of the M+1 gamma reference voltages.

In still other embodiments, the method further comprises limiting the data current using a clamp circuit.

In still other embodiments, generating the M additional gamma reference voltages based on time M gamma reference currents, respectively, comprises using M current-voltage converter circuits to generate the M additional gamma reference voltages responsive to the M gamma reference currents, respectively.

In further embodiments, a display device is operated by generating L gray scale reference currents, the L gray scale reference currents being associated with non-zero gray scale levels, selecting M gamma reference currents from the L gray scale reference currents responsive to a gamma signal, and generating a zero gray scale level gamma reference voltage. The following operations are performed for each of a plurality of data lines: selecting one of the M gamma reference currents or the zero gray scale level gamma reference voltage responsive to a color signal and generating a data current responsive to the selected one of the M gamma reference currents or zero gray scale level gamma reference voltage. The method further comprising driving a plurality of scan lines to select respective ones of a plurality of pixels that are associated with respective pairs of ones of the plurality data lines and ones of the plurality of scan lines.

In further embodiments, a data driver for a display is operated by generating L gray scale reference currents, selecting M gamma reference currents from the L gray scale reference currents responsive to a gamma signal, selecting one of the M gamma reference currents responsive to a color signal, and generating a data current responsive to the selected one of the M gamma reference currents.

In still further embodiments, selecting the M gamma reference currents comprises decoding the gamma signal to generate a gamma current selection signal, and operating M gamma selection switches that select the M gamma reference currents, respectively, responsive to the gamma current selection signal.

In still further embodiments, wherein generating the L gray scale reference currents comprises generating the L gray scale reference currents using a current mirror comprising L transistors having L different widths.

In still further embodiments, wherein selecting one of the M gamma reference currents comprises generating M gamma reference voltages based on the M gamma reference currents, respectively, and selecting one of the M gamma reference voltages responsive to the color signal. Generating the data current comprises generating the data current responsive to the selected one of the M gamma reference voltages.

In still further embodiments, selecting one of the M gamma reference voltages comprises decoding the color signal to generate a gamma reference voltage selection signal, operating one of M switches, respectively associated with the M gamma reference voltages, responsive to the gamma reference voltage selection signal to couple the selected one of the M gamma reference voltages to an output node.

In still further embodiments, generating the data current comprises driving a data current transistor coupled to the output node using the selected one of the M gamma reference voltages.

In still further embodiments, the method further comprises limiting the data current using a clamp circuit.

In still further embodiments, generating the M gamma reference voltages based on the M gamma reference currents, respectively, comprises using M current-voltage converter circuits to generate the M gamma reference voltages responsive to the M gamma reference currents, respectively.

In still further embodiments, a display device is operated by generating L gray scale reference currents and selecting M gamma reference currents from the L gray scale reference currents responsive to a gamma signal. The following operations are performed for each of a plurality of data lines: selecting one of the M gamma reference currents responsive to a color signal and generating a data current responsive to the selected one of the M gamma reference currents. The method further comprises driving a plurality of scan lines to select respective ones of a plurality of pixels that are associated with respective pairs of ones of the plurality data lines and ones of the plurality of scan lines.

In other embodiments, a data driver for a display comprises a reference current generator that is configured to generate L gray scale reference currents, the L gray scale reference currents being associated with non-zero gray scale levels, a gamma selection module that is configured to select M gamma reference currents from the L gray scale reference currents responsive to a gamma signal, a gamma voltage generator that is configured to generate a zero gray scale level gamma reference voltage, and a data current generator that is configured to generate a data current responsive to a selected one of the M gamma reference currents or the zero gray scale level gamma reference voltage responsive to a color signal.

In still other embodiments, the gamma selection module comprises a decoder that is configured to generate a gamma current selection signal responsive to the gamma signal, and M gamma selection switches that are operable to select the M gamma reference currents, respectively, responsive to the gamma current selection signal.

In still other embodiments, the reference current generator comprises a current mirror comprising L transistors having L different widths that is configured to generate the L gray scale reference currents, respectively.

In still other embodiments, the data driver further comprises M current-voltage converter circuits that are configured to generate M additional gamma reference voltages based on the M gamma reference currents, respectively. The data current generator comprises a gamma voltage selection block that is configured to select one of the M+1 gamma reference voltages responsive to the color signal, and a voltage-current converter circuit that is configured to generate the data current responsive to the selected one of the M+1 gamma reference voltages.

In still other embodiments, wherein the gamma voltage selection block comprises a decoder that is configured to generate a gamma reference voltage selection signal responsive to the color signal and M+1 switches, respectively associated with the M+1 gamma reference voltages, and operable to couple one of the M+1 gamma reference voltages to an output node responsive to the gamma reference voltage selection signal.

In still other embodiments, the voltage-current converter circuit comprises a data current transistor coupled to the output node.

In still other embodiments, the data driver further comprises a clamp circuit coupled between the data current transistor and an output reference terminal.

In further embodiments, a display device comprises a reference current generator that is configured to generate L gray scale reference currents, the L gray scale reference currents being associated with non-zero gray scale levels, a gamma selection module that is configured to select M gamma reference currents from the L gray scale reference currents responsive to a gamma signal, a gamma voltage generator that is configured to generate a zero gray scale level gamma reference voltage, a plurality of data current generators associated with a plurality of data lines, respectively, respective ones of the data current generators being configured to generate a data current responsive to a selected one of the M gamma reference currents or the zero gray scale level gamma reference voltage responsive to a color signal, and a scan driver that is configured to drive a plurality of scan lines to select respective ones of a plurality of pixels that are associated with respective pairs of ones of the plurality data lines and ones of the plurality of scan lines.

In further embodiments, a data driver for a display comprises a reference current generator that is configured to generate L gray scale reference currents, a gamma selection module that is configured to select M gamma reference currents from the L gray scale reference currents responsive to a gamma signal, and a data current generator that is configured to generate a data current responsive to a selected one of the M gamma reference currents responsive to a color signal.

In still further embodiments, the gamma selection module comprises a decoder that is configured to generate a gamma current selection signal responsive to the gamma signal, and M gamma selection switches that are operable to select the M gamma reference currents, respectively, responsive to the gamma current selection signal.

In still further embodiments, the reference current generator comprises a current mirror comprising L transistors having L different widths that is configured to generate the L gray scale reference currents, respectively.

In still further embodiments, the data driver further comprises M current-voltage converter circuits that are configured to generate M gamma reference voltages based on the M gamma reference currents, respectively. The data current generator comprises a gamma voltage selection block that is configured to select one of the M gamma reference voltages responsive to the color signal, and a voltage-current converter circuit that is configured to generate the data current responsive to the selected one of the M gamma reference voltages.

In still further embodiments, the gamma voltage selection block comprises a decoder that is configured to generate a gamma reference voltage selection signal responsive to the color signal, and M switches, respectively associated with the M gamma reference voltages, and operable to couple one of the M gamma reference voltages to an output node responsive to the gamma reference voltage selection signal.

In still further embodiments, the voltage-current converter circuit comprises a data current transistor coupled to the output node.

In still further embodiments, the data driver further comprises a clamp circuit coupled between the data current transistor and an output reference terminal.

In other embodiments, a display device, comprises a reference current generator that is configured to generate L gray scale reference currents, a gamma selection module that is configured to select M gamma reference currents from the L gray scale reference currents responsive to a gamma signal, a plurality of data current generators associated with a plurality of data lines, respectively, respective ones of the data current generators being configured to generate a data current responsive to a selected one of the M gamma reference currents responsive to a color signal, and a scan driver that is configured to drive a plurality of scan lines to select respective ones of a plurality of pixels that are associated with respective pairs of ones of the plurality data lines and ones of the plurality of scan lines.

BRIEF DESCRIPTION OF THE DRAWINGS

Other features of the present invention will be more readily understood from the following detailed description of specific embodiments thereof when read in conjunction with the accompanying drawings, in which.

DETAILED DESCRIPTION OF EMBODIMENTS

Figure 1:
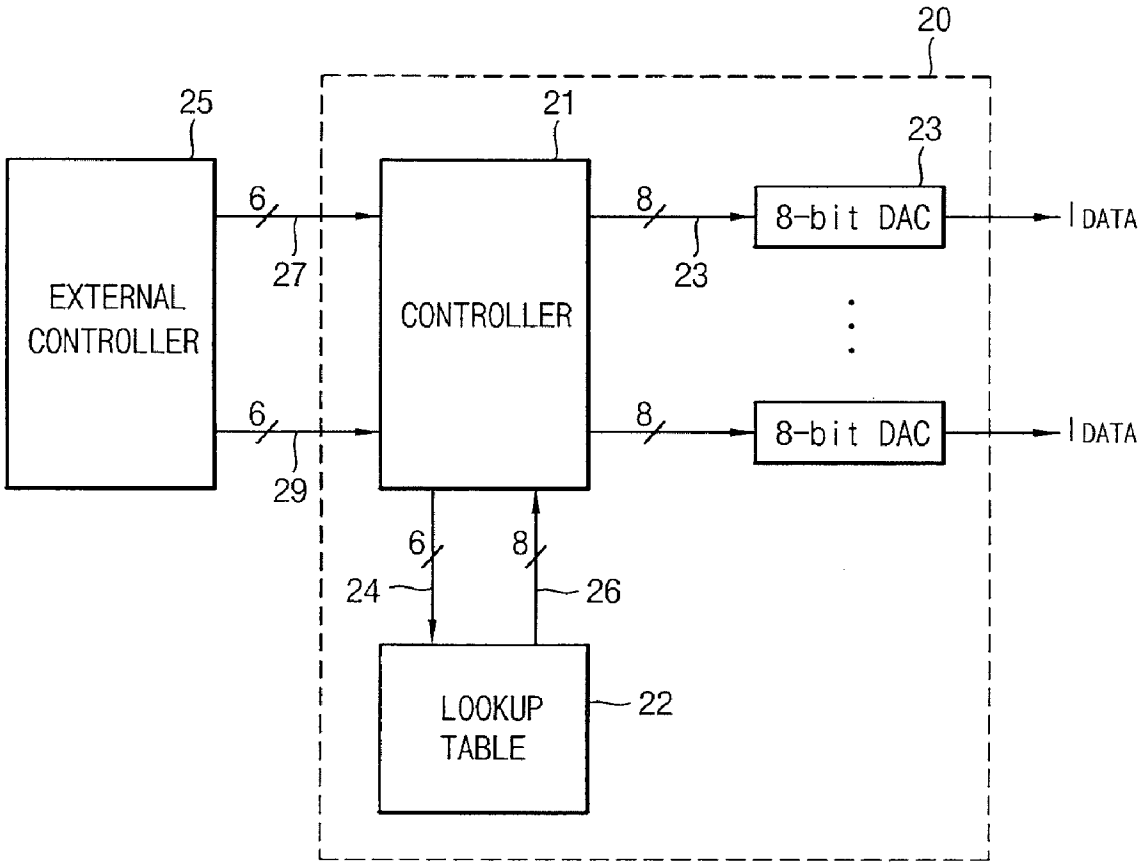
FIG. 1 (PRIOR ART)
FIG. 1 is a block diagram of a conventional data driver circuit for a display that provides gamma correction.

While the present invention is susceptible to various modifications and alternative forms, specific embodiments thereof are shown by way of example in the drawings and will herein be described in detail. It should be understood, however, that there is no intent to limit the invention to the particular forms disclosed, but on the contrary, the invention is to cover all modifications, equivalents, and alternatives falling within the spirit and scope of the invention as defined by the claims.

It will be understood that when an element is referred to as being "connected to" or "coupled to" another element, it can be directly connected or coupled to the other element or intervening elements may be present. In contrast, when an element is referred to as being "directly connected to" or "directly coupled to" another element, there are no intervening elements. As used herein, the term "and/or" and "/" includes any and all combinations of one or more of the associated listed items. Like numbers refer to like elements throughout the description.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that although the terms first and second are used herein to describe various components, circuits, regions, layers and/or sections, these components, circuits, regions, layers and/or sections should not be limited by these terms. These terms are only used to distinguish one component, circuit, region, layer or section from another component, circuit, region, layer or section. Thus, a first component, circuit, region, layer or section discussed below could be termed a second component, circuit, region, layer or section, and similarly, a second component, circuit, region, layer or section may be termed a first component, circuit, region, layer or section without departing from the teachings of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Some embodiments of the present invention stem from a realization that, for example, 8-bit gray scale color data may be selected using a 6-bit color data signal without the need for a look-up table. As a result, chip area may be conserved and improved granularity may be provided in using 8-bit gray scale color signals to drive a display.

Figure 2:
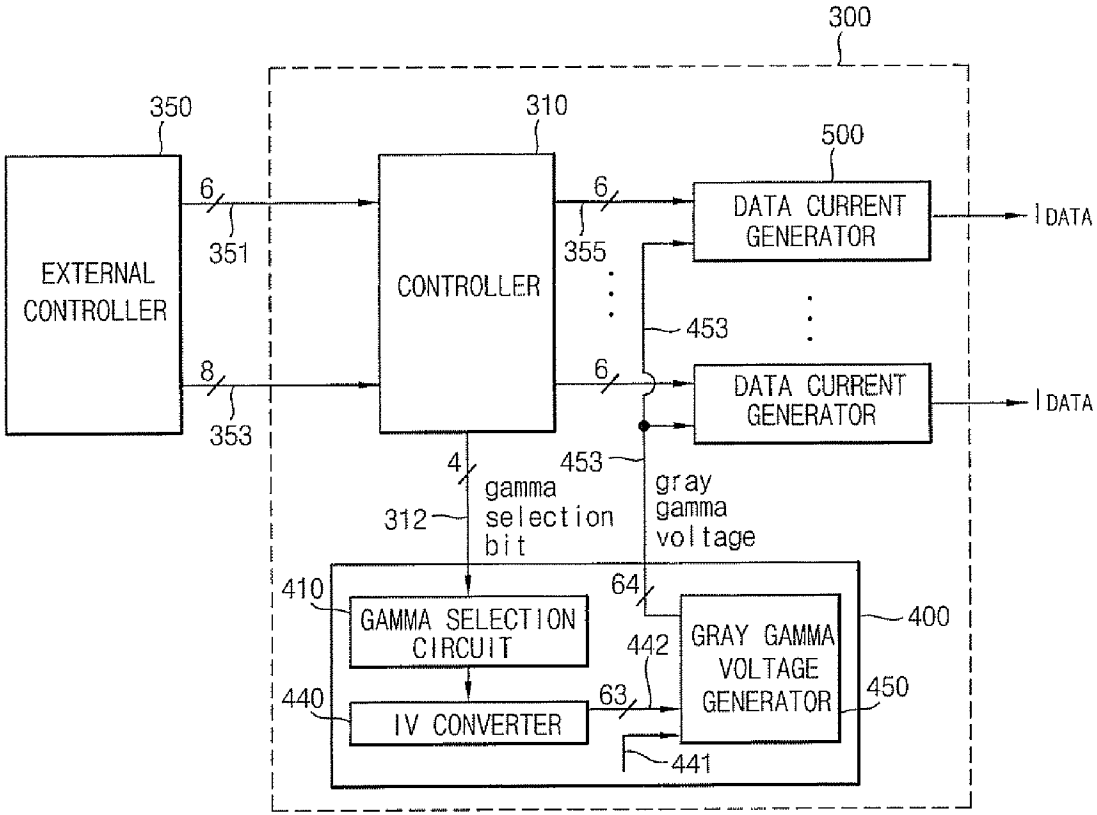
FIG. 2 is a block diagram of a data driver circuit according to some embodiments of the present invention.

Referring to FIG. 2, a data driver circuit 300 for a display, according to some embodiments of the present invention, includes a plurality of data current generators 500 that generate the data current IDATA in response to gray scale data 355 and a gray scale gamma voltage 453. The data driver circuit 300 further includes a gamma setting block 400 that is configured to select a plurality of gamma reference currents in response to a gamma selection signal. The gamma reference currents are converted to gray scale gamma reference voltages. A gray scale gamma reference voltage may be selected for output responsive to a color signal.

As shown in FIG. 2, the data driver circuit 300 includes a controller 310 that is configured to receive a Q-bit color or video data signal 351 and a gamma setting command signal 353 from an external controller 350. When $2^{18}$ colors are desired, then a 6-bit color signal 351 is used for each of the R, G, and B colors. When $2^{24}$ colors are desired, then an 8-bit color signal 351 is used for each of the R, G, and B colors.

The controller uses the gamma setting command signal 353 to generate a gamma selection signal 312, which is provided to the gamma setting block 400. In some embodiments, the gamma setting command signal 353 may be used to select a gamma value that is preset to a defined value. The gamma selection signal 312 may be N-bits to allow selection of a gamma value among $2^N$ possible gamma values.

The gamma setting block 400 includes a gamma selection circuit 410, an IV (current-to-voltage) converter 440, and a gray scale gamma voltage generator 450. The gamma selection circuit 410 is configured to generate L gray scale reference currents and to select M of the gray scale reference currents as gamma reference currents responsive to the gamma selection signal 312. In some embodiments, L is 255 when 8-bits are used to define the gay scale levels.

The data driver circuit 300 provides K gamma curves, such that each gamma curve includes M gamma reference currents, which correspond to different gray scale levels. Thus, the data driver circuit 300 provides K gamma reference current groups. For example, if K=10, then there are 10 gamma reference current groups and one of the gamma reference current groups is selected responsive to the gamma selection signal 312. Accordingly, at least 4-bits are used for the gamma selection signal 312 as $2^N$>K. In some embodiments, L is greater than M to provide improved granularity in generating the M gamma reference currents. If L=255, then 256 gray scale reference currents are generated and if L=511, then 512 gray scale reference currents are generated.

The gamma setting block 400 includes the gamma selection circuit 410, the IV converter 440, and the gray scale gamma voltage generator 450. The IV converter 440 is configured to convert the M gamma currents output from the gamma selection circuit 410 to M gamma voltages 442. The gray gamma voltage generator 450 generates M+1 gray gamma voltages 453 in response to the M gamma voltages 442. The M+1 gray gamma voltages may be based on the M gamma voltages 442 along with a zero gray scale gamma reference voltage. The data current generator 500 selects one of the M+1 gray gamma voltages in response to a video/color data signal 355 and generates the data current IDATA responsive to the selected gray gamma voltage.

Figure 3:
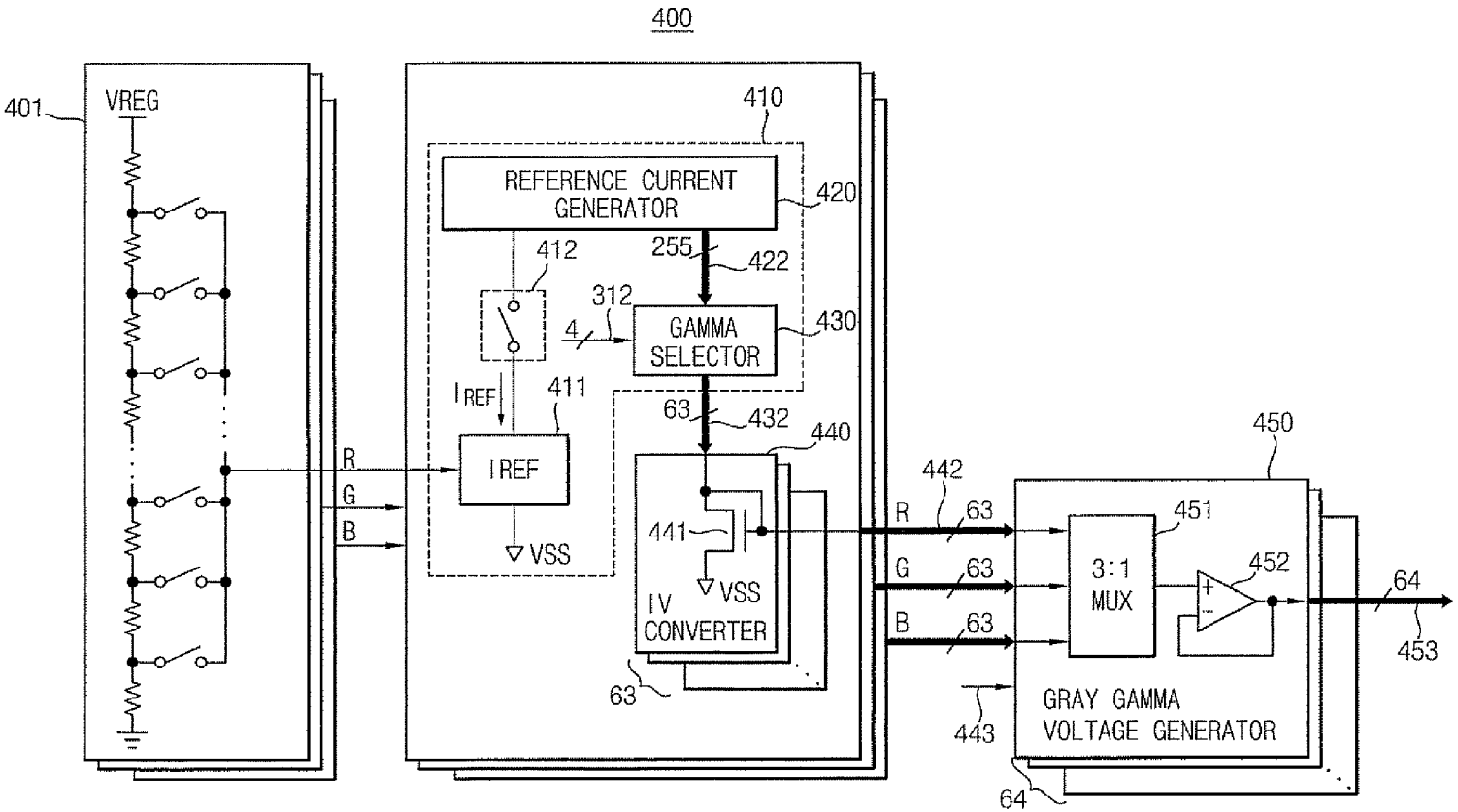
FIG. 3 is a block diagram of the gamma setting block of FIG. 2 in accordance with some embodiments of the present invention.

FIG. 3 is a block diagram of the gamma setting block 400 in accordance with some embodiments of the present invention. The gamma setting block includes the gamma selection circuit 410, the IV converter 440, and the gray scale gamma voltage generator 450. The gamma selection circuit 410 includes a reference current source generator 411, a reference current switch 412, a reference current generator 420, and a gamma selector 430, which are connected as shown. The reference current source generator 411 generates the reference current IREF and provides the reference current IREF to the reference current generator 420. In some embodiments, the gamma setting block 400 may include a gray scale reference voltage generator 401 that provides R, G, and B gray scale reference voltages or provides common gray scale reference voltages. If the R, G, and B gray scale reference voltages are provided independently, then the reference current switch 412 may select the gray scale reference voltage corresponding to the desired color. As shown in FIG. 3, the gray scale reference voltages may be generated by using a voltage divider circuit for a constant voltage VREG. The reference current generator 420 generates the L gray scale reference currents 422 responsive to the reference current IREF. The gamma selector 430 outputs the M gamma reference currents 432 responsive to the L gray scale reference currents 422 and the N bit gamma selection signal 312. The IV converter 440 generates M gamma voltages 442 responsive to the M gamma reference currents 432. In some embodiments, the IV converter 440 may include M MOS transistors 441 that are respectively operated in saturation mode such that the gate-source voltage is controlled by the drain current. The gray scale gamma voltage generator 450 receives the M gamma voltages 442 for each of the R, G, and B colors and the zero gray scale level voltage 443 and generates M+1 gray gamma voltages 453 in response thereto through use, for example, of a multiplexer circuit 451 and voltage follower circuit 452. The zero gray scale level voltage 443 may correspond to a ground or common reference voltage.

Figure 4:
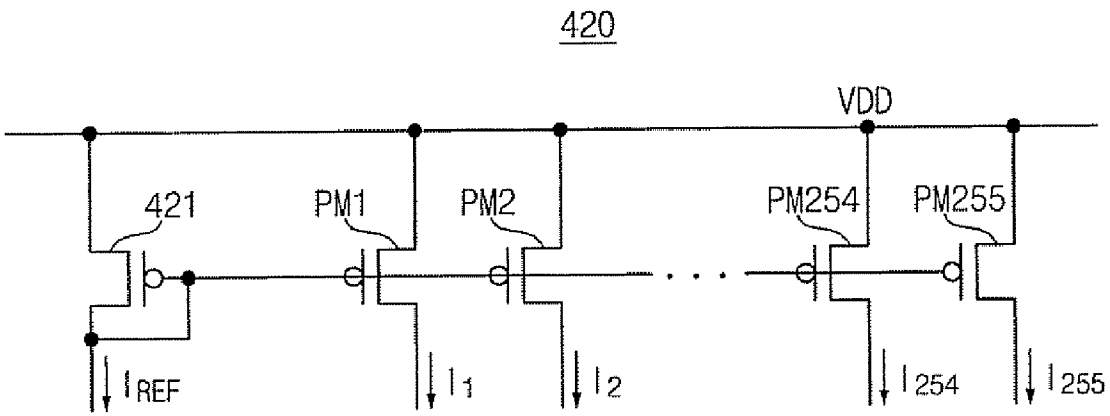
FIG. 4 is a schematic of the reference current generator of FIG. 3 in accordance with some embodiments of the present invention.

FIG. 4 is a schematic of the reference current generator 420 in accordance with some embodiments of the present invention. The reference current generator 420 may comprise a current mirror circuit including an input transistor 421 and L mirroring transistor PM1 through PM255. In accordance with various embodiments of the present invention, the mirroring transistors may be PMOS or NMOS transistors. The current $I_1$ may correspond to being one level higher than the zero gray scale level and the current $I_{255}$ may correspond to being the brightest gray scale level. The transistors PM1 through PM255 may have different respective widths so as to generate different currents.

Figure 5:
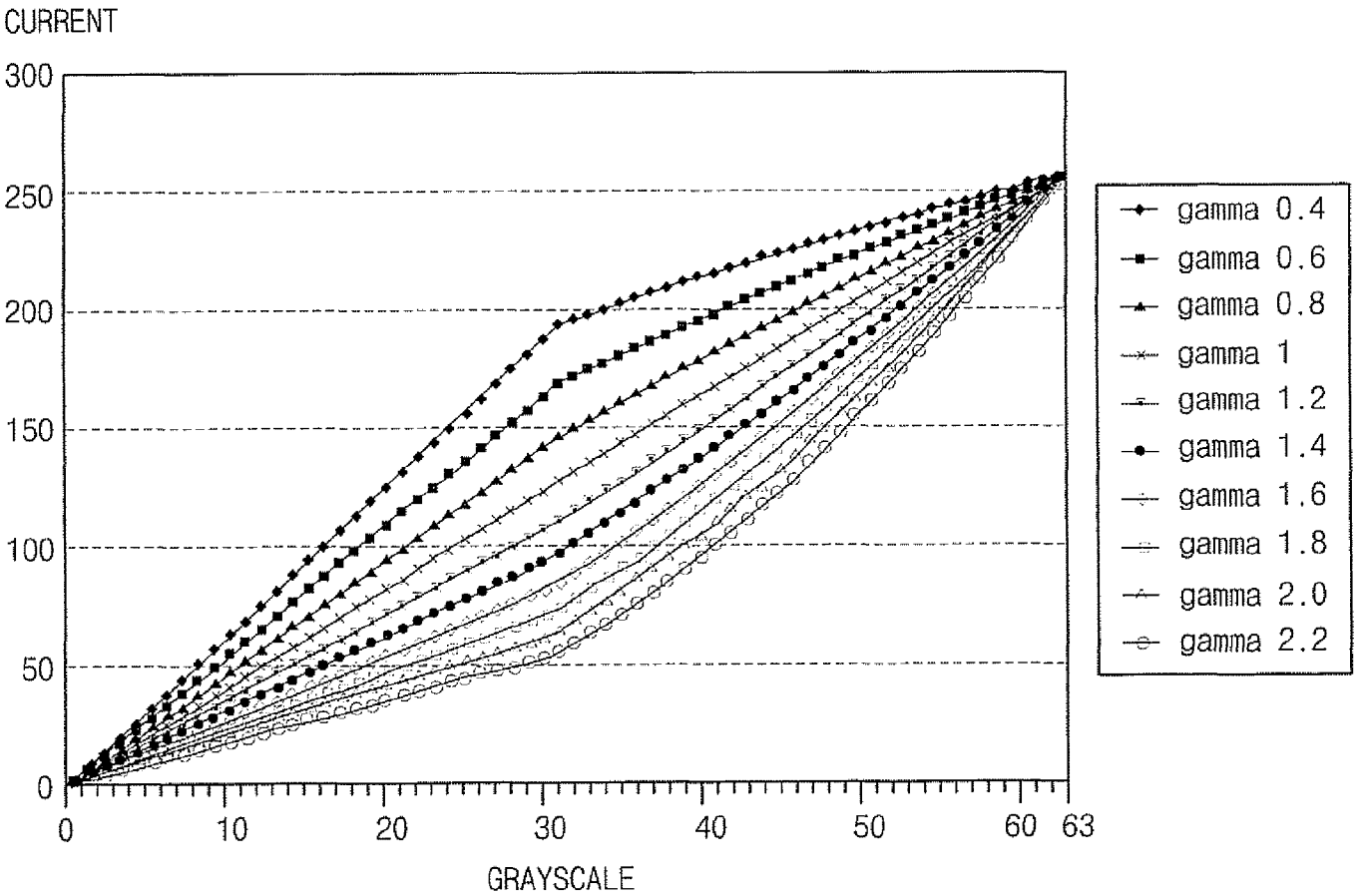
FIG. 5 is a gamma correction curve for the example in which there are 256 gray scale reference currents, 64 gamma reference currents, and 10 gamma curves in accordance with some embodiments of the present invention.

FIG. 5 is a gamma correction curve for the example in which there are 256 gray scale reference currents (L=255), 64 gamma reference currents (M=63), and 10 gamma curves (K=10). The gamma values increase from 0.4 to 2.2 by 0.2. Advantageously, it may be possible to approximate 8-bit gray scale levels using a 6-bit color data signal. By selecting 8-bit gray scale levels based on a 6-bit color data signal, it is possible to provide improved granularity in the gray scale levels. Table 1 below shows the gray scale reference currents for the 28th gray scale level.

TABLE 1

| gamma | Gray reference |
|---|---|
| 0.4 | 180 |
| 0.6 | 158 |
| 0.8 | 136 |
| 1.0 | 120 |
| 1.2 | 105 |
| 1.4 | 92 |
| 1.6 | 78 |
| 1.8 | 67 |
| 2.0 | 59 |
| 2.2 | 50 |

Figure 6:
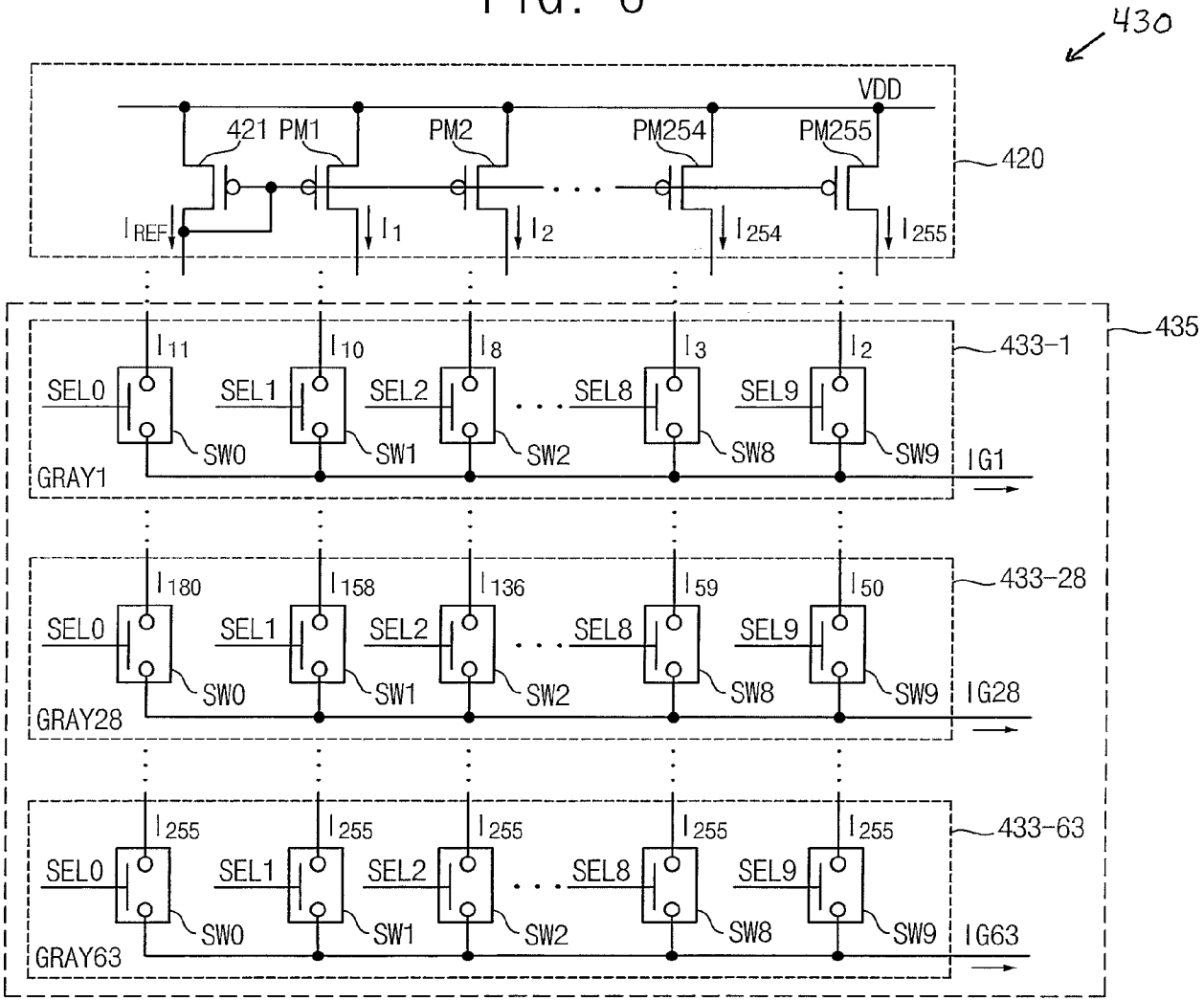
FIG. 6 is a schematic of the gamma selector of FIG. 3 in accordance with some embodiments of the present invention.

FIG. 6 is a schematic of the gamma selector 430 in accordance with some embodiments of the present invention. The gamma selector 430 includes a switch circuit 435 that includes M switch blocks 433-1 through 433-63 when M=63. If K is 10, then each switch block includes 10 switches SW0 through SW9. The switches SW0-SW9 are connected to one of the mirroring transistors PM1-PM255 of the reference current generator 420. One switch is turned on and the other switches are turned off in response to the N bit gamma selection signal 312. The ten switches of the switch block 433-28, which correspond to the 28th gray scale level are connected to mirroring transistors PM180, PM158, PM136, PM120, PM105, PM92, PM78, PM67, PM59, and PM50, respectively. If a gamma value of 2.0 is selected, then the gamma selection signal SEL8 turns on the 9th switch and the 59th gray reference current I59 is output as gamma current IG28, which corresponds to the 28th gray scale level. If a gamma value of 2.0 is selected, then the 63 switches that are responsive to the gamma selection signal SEL8 are turned on and the 63 gamma currents IG1-IG63 are output. The 63 gamma currents are called one gamma current group and the gamma current group is selected by the N bit gamma selection signal 312.

Figure 7:
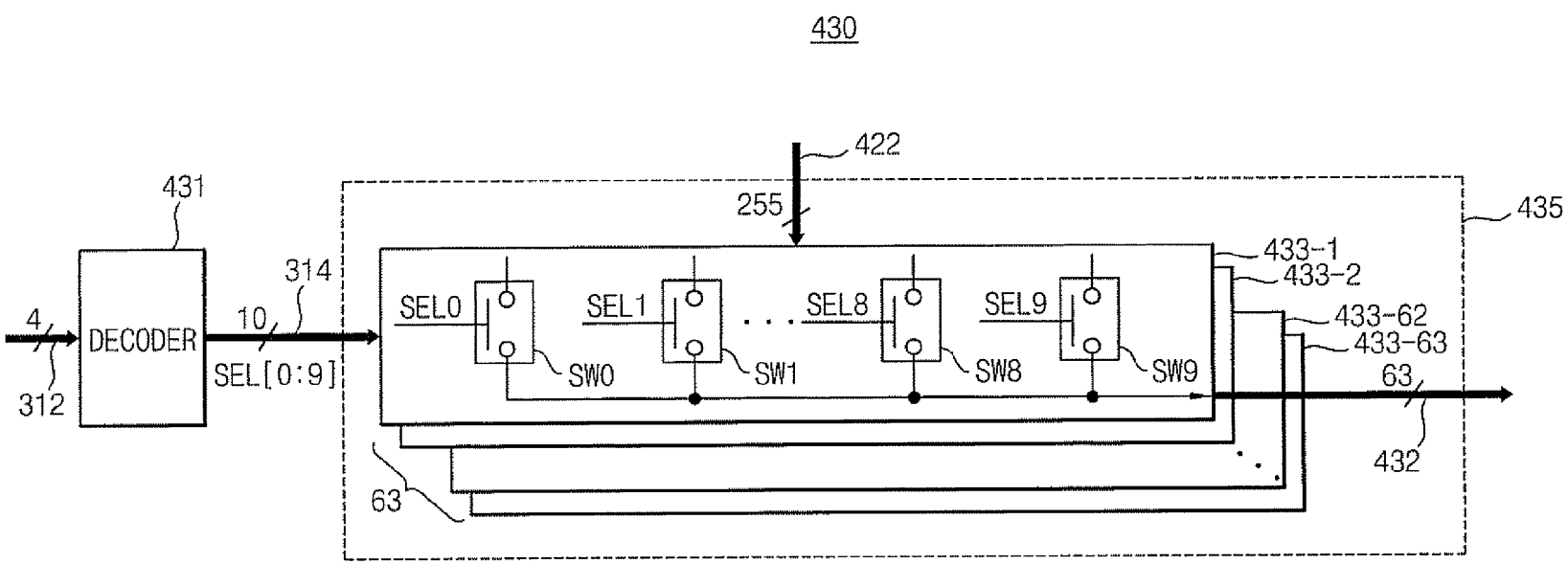
FIG. 7 is a block diagram of the gamma selector of FIG. 3 in accordance with further embodiments of the present invention.

FIG. 7 is a block diagram of the gamma selector 430 in accordance with further embodiments of the present invention. The gamma selector 430 includes a decoder 431 and the switch circuit 435. The decoder 431 decodes the N bit gamma selection signal 312 and outputs a switch selection signal 314. In some embodiments, the decoder 431 may be a demultiplexer circuit. The switches SW0-SW9 are connected to the M mirroring transistors. If the Ith gamma current group is selected, then the appropriate switches are turned on and the currents associated with the Ith gamma current group are output at the same time. In this embodiment, a gamma reference current associated with the zero gray scale reference level is not generated.

Figure 8:
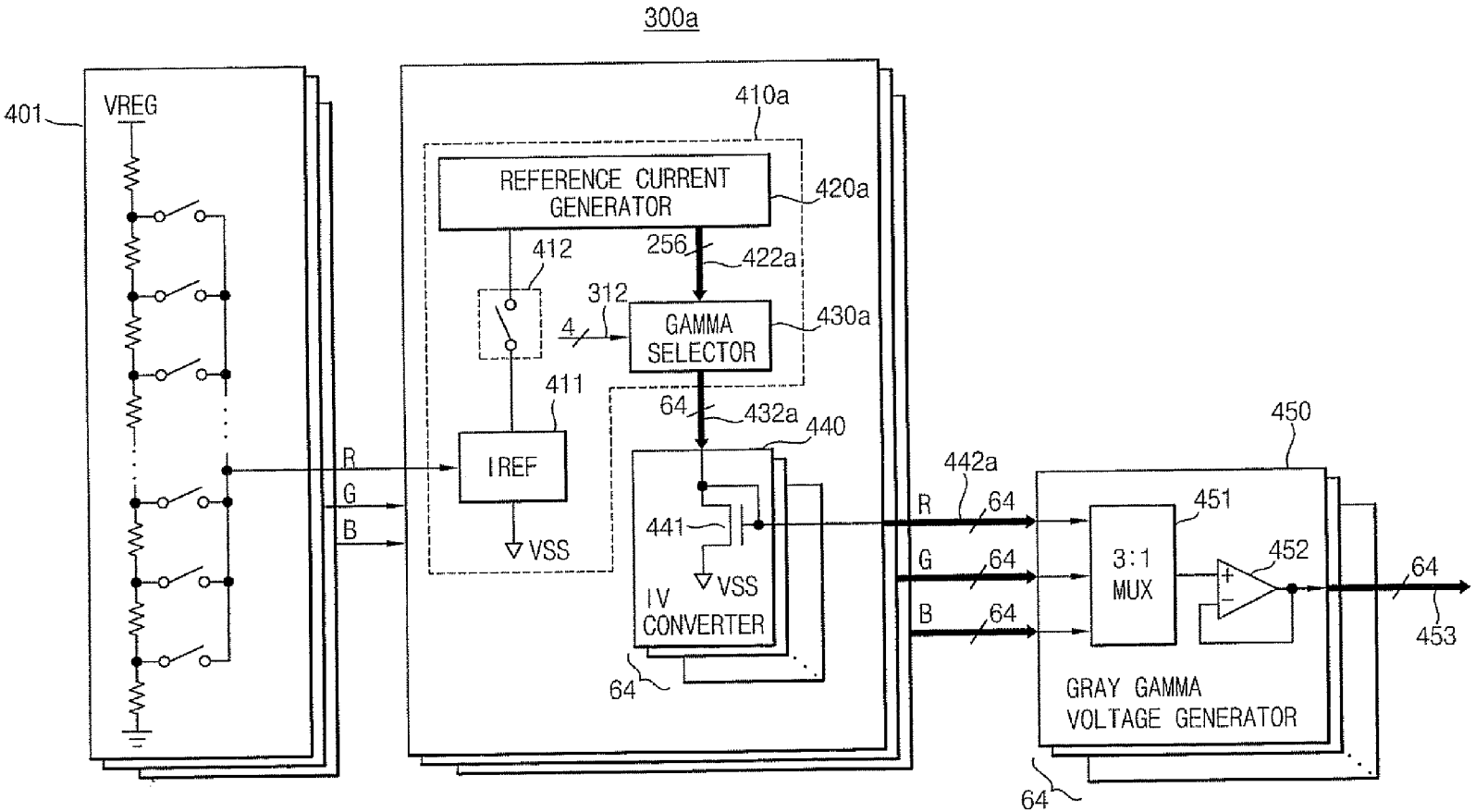
FIG. 8 is a block diagram of a data driver circuit according to further embodiments of the present invention.

Referring to FIG. 8, a data driver circuit 300*a* for a display, according to some embodiments of the present invention, is illustrated. The data driver circuit 300*a* is similar to the data driver circuit 300 of FIGS. 2 and 3 with the exception that the gamma selection circuit 410*a*, reference current generator 420*a*, and gamma selector 430*a* cooperate to generate L+1 gray scale reference currents 422*a* and M+1 gamma reference currents 432*a*. The L+1 gray scale reference currents 422*a* include a current corresponding to the zero gray scale reference level and the M+1 gamma reference currents 432*a* include a current corresponding to the zero gray scale reference level. Thus, if L=255, then 256 gray scale reference currents 422*a* are generated and if M=63, then 64 gamma reference currents 432*a* are generated.

Figure 9:
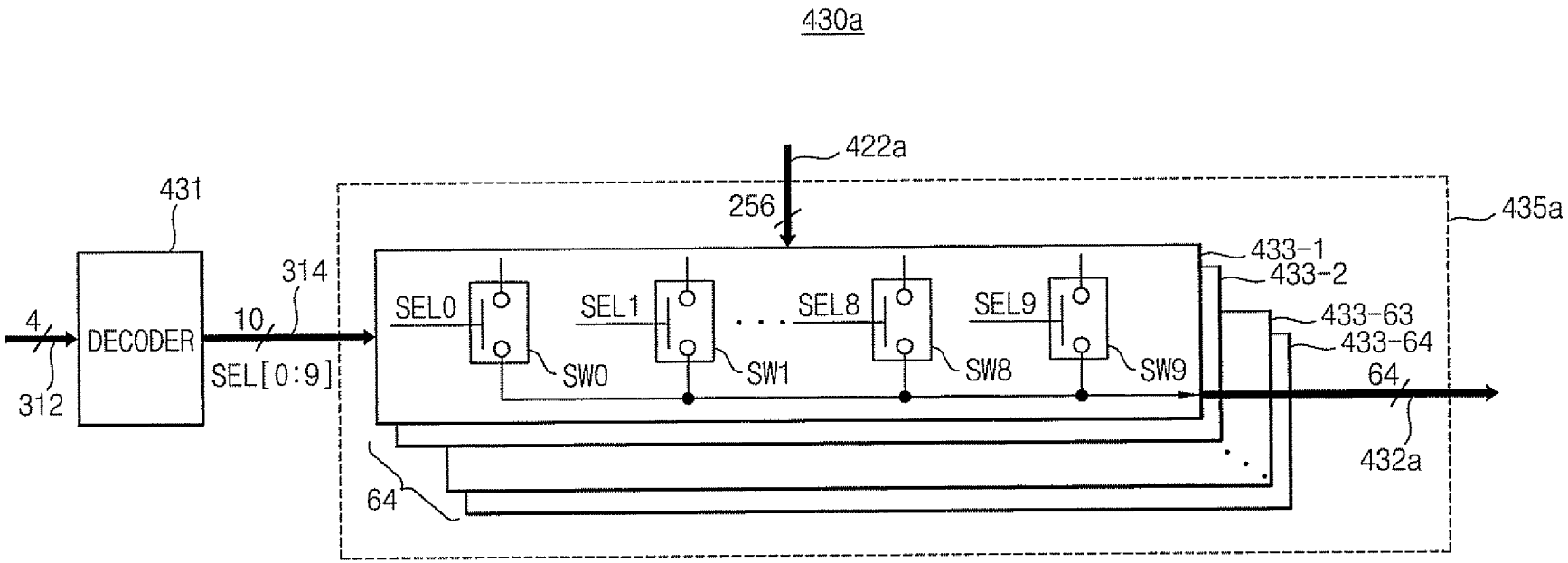
FIG. 9 is a block diagram of the gamma selector of FIG. 8 in accordance with further embodiments of the present invention.

FIG. 9 is a block diagram of the gamma selector 430*a* in accordance with further embodiments of the present invention. The gamma selector 430*a* is similar to the gamma selector 430 illustrated in FIG. 7, with the exception that the switch circuit 435*a* includes 64 switch blocks 433-1-433-64 instead of 63 switch blocks 433-1-433-63 as shown in FIG. 7. The additional switch block corresponds to the zero gray scale reference level.

Figure 10:
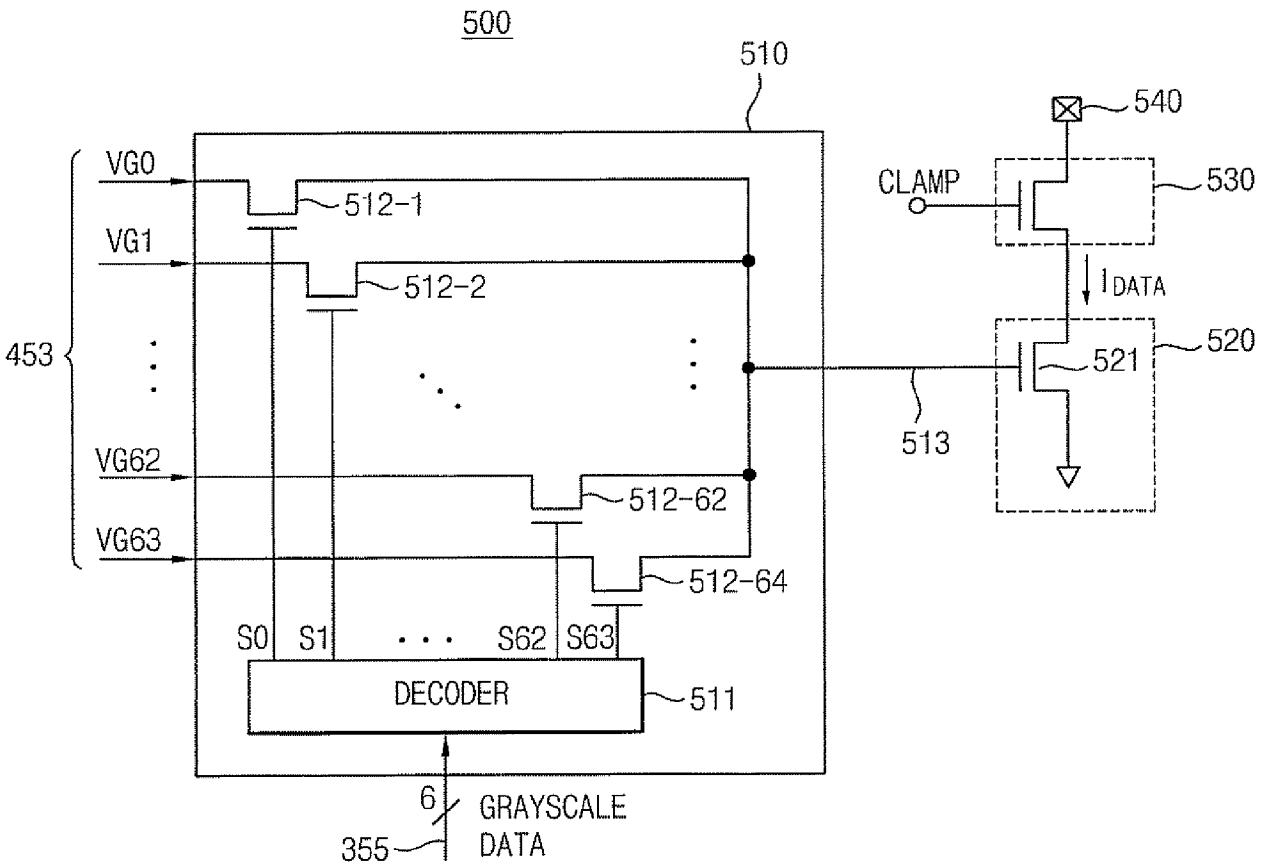
FIG. 10 is a schematic of the data current generator of FIGS. 3 and 8 in accordance with some embodiments of the present invention.

FIG. 10 is a schematic of the data current generator 500 in accordance with some embodiments of the present invention. The data current generator 500 includes a gray gamma voltage selection block 510, a voltage to current converter 520, and an output node 540 that are connected as shown. The gray gamma voltage selection block includes a decoder 511 and M+1 switches 512. The decoder receives the Q-bit gray data color signal 355 from the controller 310. The switches 512 select one of the M+1 gray gamma voltages 453 responsive to the gray data color signal 355. The voltage to current converter 520 is a driving transistor of which the drain current is controlled by the output of the gray gamma voltage selection block 510. The drain current is output as data current DATA. In some embodiments, the data current generator 520 may be coupled to a clamp circuit 530 to limit the data current IDATA in response to a CLAMP signal.

Figure 11:
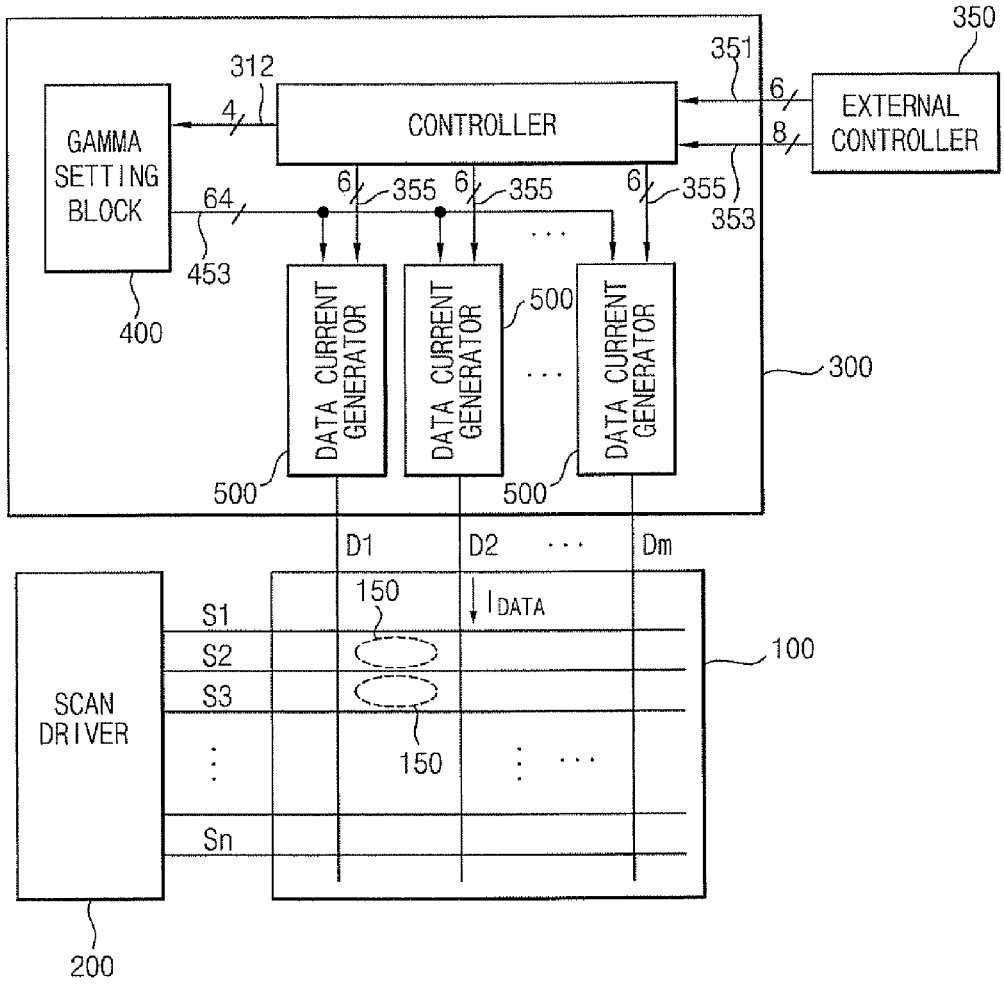
FIG. 11 is a block diagram of a display device that includes a data driver in accordance with some embodiments of the present invention.

FIG. 11 is a block diagram of a display device that includes a data driver in accordance with some embodiments of the present invention. The display device includes a display panel 100, a scan driver 200, and a data driver 300. The data driver 300 may be embodied as described above with respect to FIGS. 2-10. The panel 100 may include a plurality of OLED pixels 150. The san driver 200 provides scan signals to the scan lines S1-Sn. The data driver circuit 300 may provide gray scale driving currents D1-DM as described above.

In concluding the detailed description, it should be noted that many variations and modifications can be made to the preferred embodiments without substantially departing from the principles of the present invention. All such variations and modifications are intended to be included herein within the scope of the present invention, as set forth in the following claims.

That which is claimed:

1. A method of operating a data driver for a display, comprising:

generating L gray scale reference currents simultaneously, the L gray scale reference currents comprising K gamma reference current groups and being associated with non-zero gray scale levels, each of the K gamma reference current groups having M of the L scale reference currents as gamma reference currents;

selecting M gamma reference currents, which are included in one of the K gamma reference current groups, from the L gray scale reference currents responsive to a gamma signal;

generating a zero gray scale level gamma reference voltage;

selecting one of the M gamma reference currents or the zero gray scale level gamma reference voltage responsive to a color signal; and generating a data current responsive to the selected one of the M gamma reference currents or zero gray scale level gamma reference voltage;

wherein L is greater than one; and wherein generating the L gray a scale reference currents comprises generating the L gray scale reference currents using a current mirror comprising L transistors having L different widths.

2. The method of claim 1, wherein selecting the M gamma reference currents comprises:

decoding the gamma signal to generate a gamma current selection signal; and operating M gamma selection switches that select the M gamma reference currents, respectively, responsive to the gamma current selection signal.

3. The method of claim 1, wherein selecting one of the M gamma reference currents or the zero gray scale level gamma reference voltage, comprises:

generating M additional gamma reference voltages based on the M gamma reference currents, respectively; and selecting one of the M+1 gamma reference voltages responsive to the color signal; and wherein generating the data current, comprises:

generating the data current responsive to the selected one of the M+1 gamma reference voltages.

4. The method of claim 3, wherein selecting one of the M+1 gamma reference voltages comprises:

decoding the color signal to generate a gamma reference voltage selection signal;

operating one of M+1 switches, respectively associated with the M+1 gamma reference voltages, responsive to the gamma reference voltage selection signal to couple the selected one of the M+1 gamma reference voltages to an output node.

5. The method of claim 4, wherein generating the data current comprises:

driving a data current transistor coupled to the output node using the selected one of the M+1 gamma reference voltages.

6. The method of claim 5, further comprising:

limiting the data current using a clamp circuit.

7. The method of claim 3, wherein generating the M additional gamma reference voltages based on the M gamma reference currents, respectively, comprises:

using M current-voltage converter circuits to generate the M additional gamma reference voltages responsive to the M gamma reference currents, respectively.

8. A method of operating a display device, comprising:

generating L gray scale reference currents simultaneously, the L gray scale reference currents comprising K gamma reference current groups and being associated with non-zero gray scale levels, each of the K gamma reference current groups having M of the L scale reference currents as gamma reference currents;

selecting M gamma reference currents, which are included in one of the K gamma reference current groups, from the L gray scale reference currents responsive to a gamma signal;

generating a zero gray scale level gamma reference voltage;

for each of a plurality of data lines:

selecting one of the M gamma reference currents or the zero gray scale level gamma reference voltage responsive to a color signal; and generating a data current responsive to the selected one of the M gamma reference currents or zero gray scale level gamma reference voltage; and driving a plurality of scan lines to select respective ones of a plurality of pixels that are associated with respective pairs of ones of the plurality data lines and ones of the plurality of scan lines;

wherein L is greater than one; and wherein generating the L gray scale reference currents comprises generating the L gray scale reference currents using a current mirror comprising L transistors having L different widths.

9. A method of operating a data driver for a display, comprising:

generating L gray scale reference currents simultaneously, the L gray scale reference currents comprising K gamma reference current groups and being associated with non-zero gray scale levels, each of the K gamma reference current groups having M of the L scale reference currents as gamma reference currents;

selecting M gamma reference currents, which are included in one of the K gamma reference current groups, from the L gray scale reference currents responsive to a gamma signal;

selecting one of the M gamma reference currents responsive to a color signal; and generating a data current responsive to the selected one of the M gamma reference currents;

wherein L is greater than one; and wherein generating the L gray a scale reference currents comprises generating the L gray scale reference currents using a current mirror comprising L transistors having L different widths.

10. The method of claim 9, wherein selecting the M gamma reference currents comprises:

decoding the gamma signal to generate a gamma current selection signal; and operating M gamma selection switches that select the M gamma reference currents, respectively, responsive to the gamma current selection signal.

11. The method of claim 9, wherein selecting one of the M gamma reference currents, comprises:

generating M gamma reference voltages based on the M gamma reference currents, respectively; and selecting one of the M gamma reference voltages responsive to the color signal; and wherein generating the data current, comprises:

generating the data current responsive to the selected one of the M gamma reference voltages.

12. The method of claim 11, wherein selecting one of the M gamma reference voltages comprises:

decoding the color signal to generate a gamma reference voltage selection signal;

operating one of M switches, respectively associated with the M gamma reference voltages, responsive to the gamma reference voltage selection signal to couple the selected one of the M gamma reference voltages to an output node.

13. The method of claim 12, wherein generating the data current comprises:

driving a data current transistor coupled to the output node using the selected one of the M gamma reference voltages.

14. The method of claim 13, further comprising:

limiting the data current using a clamp circuit.

15. The method of claim 11, wherein generating the M gamma reference voltages based on the M gamma reference currents, respectively, comprises:

using M current-voltage converter circuits to generate the M gamma reference voltages responsive to the M gamma reference currents, respectively.

16. A method of operating a display device, comprising:

generating L gray scale reference currents simultaneously, the L gray scale reference currents comprising K gamma reference current groups and being associated with non-zero gray scale levels, each of the K gamma reference current groups having M of the L scale reference currents as gamma reference currents;

selecting M gamma reference currents, which are included in one of the K gamma reference current groups, from the L gray scale reference currents responsive to a gamma signal;

for each of a plurality of data lines:

selecting one of the M gamma reference currents responsive to a color signal; and generating a data current responsive to the selected one of the M gamma reference currents; and driving a plurality of scan lines to select respective ones of a plurality of pixels that are associated with respective pairs of ones of the plurality data lines and ones of the plurality of scan lines;

wherein L is greater than one; and wherein generating the L gray scale reference currents comprises generating the L gray scale reference currents using a current mirror comprising L transistors having L different widths.

17. A data driver for a display, comprising:

a reference current generator that is configured to generate L gray scale reference currents, the L gray scale reference currents comprising K gamma reference current groups and being associated with non-zero gray scale levels, each of the K gamma reference current groups having M of the L scale reference currents as gamma reference currents;

a gamma selection module that is configured to select M gamma reference currents, which are included in one of the K gamma reference current groups, from the L gray scale reference currents responsive to a gamma signal;

a gamma voltage generator that is configured to generate a zero gray scale level gamma reference voltage; and a data current generator that is configured to generate a data current responsive to a selected one of the M gamma reference currents or the zero gray scale level gamma reference voltage responsive to a color signal;

wherein L is greater than one; and wherein generating the L gray scale reference currents comprises generating the L gray scale reference currents using a current mirror comprising L transistors having L different widths.

18. The data driver of claim 17, wherein the gamma selection module comprises:

a decoder that is configured to generate a gamma current selection signal responsive to the gamma signal; and M gamma selection switches that are operable to select the M gamma reference currents, respectively, responsive to the gamma current selection signal.

19. The data driver of claim 17, further comprising:

M current-voltage converter circuits that are configured to generate M additional gamma reference voltages based on the M gamma reference currents, respectively; and wherein the data current generator comprises:

a gamma voltage selection block that is configured to select one of the M+1 gamma reference voltages responsive to the color signal; and a voltage-current converter circuit that is configured to generate the data current responsive to the selected one of the M+1 gamma reference voltages.

20. The data driver of claim 19, wherein the gamma voltage selection block comprises:

a decoder that is configured to generate a gamma reference voltage selection signal responsive to the color signal; and M+1 switches, respectively associated with the M+1 gamma reference voltages, and operable to couple one of the M+1 gamma reference voltages to an output node responsive to the gamma reference voltage selection signal.

21. The data driver of claim 20, wherein the voltage-current converter circuit comprises:

a data current transistor coupled to the output node.

22. The data driver of claim 21, further comprising:

a clamp circuit coupled between the data current transistor and an output reference terminal.

23. A display device, comprising:

a reference current generator that is configured to generate L gray scale reference currents, the L gray scale reference currents comprising K gamma reference current groups and being associated with non-zero gray scale levels, each of the K gamma reference current groups having M of the L scale reference currents as gamma reference currents;

a gamma selection module that is configured to select M gamma reference currents, which are included in one of the K gamma reference current groups, from the L gray scale reference currents responsive to a gamma signal;

a gamma voltage generator that is configured to generate a zero gray scale level gamma reference voltage;

a plurality of data current generators associated with a plurality of data lines, respectively, respective ones of the data current generators being configured to generate a data current responsive to a selected one of the M gamma reference currents or the zero gray scale level gamma reference voltage responsive to a color signal; and a scan driver that is configured to drive a plurality of scan lines to select respective ones of a plurality of pixels that are associated with respective pairs of ones of the plurality data lines and ones of the plurality of scan lines;

wherein L is greater than one; and wherein generating the L gray scale reference currents comprises generating the L gray scale reference currents using a current mirror comprising L transistors having L different widths.

24. A data driver for a display, comprising:

a reference current generator that is configured to generate L gray scale reference currents;

a gamma selection module that is configured to select M gamma reference currents from the L gray scale reference currents responsive to a gamma signal; and a data current generator that is configured to generate a data current responsive to a selected one of the M gamma reference currents responsive to a color signal;

wherein L is greater than one; and wherein generating the L gray scale reference currents comprises generating the L gray scale reference currents using a current mirror comprising L transistors having L different widths.

25. The data driver of claim 24, wherein the gamma selection module comprises:

a decoder that is configured to generate a gamma current selection signal responsive to the gamma signal; and M gamma selection switches that are operable to select the M gamma reference currents, respectively, responsive to the gamma current selection signal.

26. The data driver of claim 24, further comprising:

M current-voltage converter circuits that are configured to generate M gamma reference voltages based on the M gamma reference currents, respectively; and wherein the data current generator comprises:

a gamma voltage selection block that is configured to select one of the M gamma reference voltages responsive to the color signal; and a voltage-current converter circuit that is configured to generate the data current responsive to the selected one of the M gamma reference voltages.

27. The data driver of claim 26, wherein the gamma voltage selection block comprises:

a decoder that is configured to generate a gamma reference voltage selection signal responsive to the color signal; and M switches, respectively associated with the M gamma reference voltages, and operable to couple one of the M gamma reference voltages to an output node responsive to the gamma reference voltage selection signal.

28. The data driver of claim 27, wherein the voltage-current converter circuit comprises:

a data current transistor coupled to the output node.

29. The data driver of claim 28, further comprising:

a clamp circuit coupled between the data current transistor and an output reference terminal.

30. A display device, comprising:

a reference current generator that is configured to generate L gray scale reference currents, the L gray scale reference currents comprising K gamma reference current groups and being associated with non-zero gray scale levels, each of the K gamma reference current groups having M of the L scale reference currents as gamma reference currents;

a gamma selection module that is configured to select M gamma reference currents, which are included in one of the K gamma reference current groups, from the L gray scale reference currents responsive to a gamma signal;

a plurality of data current generators associated with a plurality of data lines, respectively, respective ones of the data current generators being configured to generate a data current responsive to a selected one of the M gamma reference currents responsive to a color signal; and a scan driver that is configured to drive a plurality of scan lines to select respective ones of a plurality of pixels that are associated with respective pairs of ones of the plurality data lines and ones of the plurality of scan lines;

wherein L is greater than one; and wherein generating the L gray scale reference currents comprises generating the L gray scale reference currents using a current mirror comprising L transistors having L different widths.

* * * * *